US005136132A

United States Patent [19]

Kitchen

[11] Patent Number: 5,136,132

[45] Date of Patent: Aug. 4, 1992

[54] ALTERNATE ACTION MECHANISM

[75] Inventor: Robert D. Kitchen, Johnson City

[73] Assignee: Honeywell Inc., Minneapolis, Minn.

[21] Appl. No.: 676,399

[22] Filed: Mar. 28, 1991

[51] Int. Cl.[5] ..... H01H 13/42; H01H 3/02

[52] U.S. Cl. ..... 200/525; 200/553; 200/529; 200/345

[58] Field of Search ..... 200/525, 523, 553, 529, 200/344, 345, 573, 437, 438; 74/100.1, 97.1

[56] References Cited

U.S. PATENT DOCUMENTS

| | | | |
|---|---|---|---|
| 436,412 | 9/1890 | Goold | 200/51.15 |
| 1,873,110 | 8/1932 | Butler | 200/553 |
| 2,076,073 | 4/1937 | Douglas | 200/525 |
| 2,377,134 | 5/1945 | Dietrich | 200/437 |
| 2,469,336 | 5/1949 | Kohl | 200/437 |
| 2,469,337 | 5/1949 | Kohl | 200/437 |
| 2,686,234 | 8/1954 | Obszarny | 200/6 A |
| 2,874,338 | 2/1959 | Pease | 361/351 |
| 3,038,981 | 6/1962 | Larkin | 200/438 |
| 3,277,264 | 10/1966 | Barthell | 200/525 |
| 3,316,370 | 4/1967 | Ardizzi | 200/437 |
| 3,321,983 | 5/1967 | Stevens | 200/525 |
| 3,491,220 | 1/1970 | Mitchell | 200/525 |
| 3,502,833 | 3/1970 | Rossini et al. | 200/86.5 |
| 3,535,478 | 10/1970 | Lewis | 200/431 |
| 3,586,806 | 6/1971 | Swisher | 200/525 |
| 3,596,022 | 7/1971 | Gaber et al. | 200/453 |
| 3,852,557 | 12/1974 | Brown | 200/271 |
| 4,095,070 | 6/1978 | Simpson | 200/525 |
| 4,203,017 | 5/1980 | Lee | 200/437 |
| 4,215,257 | 7/1980 | Repplinger | 200/437 |
| 4,408,106 | 10/1983 | Sorenson | 200/433 |
| 4,466,302 | 8/1984 | Harris | 200/341 |
| 4,473,728 | 9/1984 | Sketch | 200/431 |

FOREIGN PATENT DOCUMENTS

| | | | |
|---|---|---|---|
| 26542 | 8/1920 | Denmark . | |
| 400141 | 8/1924 | Fed. Rep. of Germany | 200/525 |
| 2416969 | 10/1975 | Fed. Rep. of Germany | 200/525 |
| 2827854 | 1/1980 | Fed. Rep. of Germany . | |
| 559541 | 9/1923 | France | 200/525 |
| 634964 | 3/1928 | France | 200/529 |
| 580414 | 11/1928 | France . | |
| 35809 | 10/1971 | Japan | 200/525 |
| 1233571 | 5/1971 | United Kingdom . | |

*Primary Examiner*—Henry J. Recla
*Assistant Examiner*—Keith Kupterschmid
*Attorney, Agent, or Firm*—William D. Lanyi

[57] ABSTRACT

An alternate action mechanism in which a rocker makes rolling contact with a surface on a frame, and a plunger is positioned to exert a force toward the surface at a location on the rocker separated from the rolling contact, the force at least initially being along an axis which intersects the surface between limiting positions of the rolling contact. Specially configured leaf springs bias the rocker toward positions corresponding with the limiting positions of the rolling contact.

25 Claims, 2 Drawing Sheets

ALTERNATE ACTION MECHANISM

BACKGROUND OF THE INVENTION

The invention disclosed herein relates generally to mechanisms which respond to successive actuations by assuming alternate states, and more particularly to low travel, high tactile feedback push button mechanisms of the type in which successive operations of a plunger alternately index a movable member from one position to another. The disclosed mechanism is particularly well adapted to alternately operating electrical switches.

It is well known to equip electrical switches and similar devices with push button actuators. Such actuators may be fabricated as part of the switches, or may be separately fabricated and combined with one or more switches. It is also well known to utilize push button actuators which, on successive depressions, cause switch contacts to alternately engage and disengage. For various applications it is required or desirable that push button actuators exhibit small button travel. It is also required in some applications that such actuators provide high tactile feedback.

Push button actuators which provide for alternate switch action are generally one of two types. In one type, means is provided for latching a push button actuator in a retracted position on alternate depressions. In its retracted position, the actuator is effective to either make or break a circuit. In the other type, successive strokes of the actuator alternately index a movable carrier from one position to another so as to provide for alternately engaging and disengaging contacts in one or more contact pairs.

A variety of constructions embodying the last described concept are known. Representative examples are disclosed in the following patents.

| Patent No. | Date | Inventor |
|---|---|---|
| 436,412 (US) | 09/16/1890 | F. Goold |
| 2,469,337 (US) | 05/03/1949 | E. Kohl |
| 3,277,264 (US) | 06/12/1962 | R. Larkin |
| 3,586.806 (US) | 06/22/1971 | W. Swisher |
| 4,095,070 (US) | 06/13/1978 | K. Simpson |
| 1,233,571 (GB) | 05/26/1971 | B. Baumanis |

The implementations disclosed in U.S. Pat. Nos. 436,412, 3,277,264 and 4,095,070 and British patent 1,233,571, each use a pivoting carrier or member rotatable about a rivet, screw, stub shaft or yoke. In each case the pivot axis is fixed with respect to the switch housing. The pivoting carrier has a surface thereon configured with a pair of notches for receiving the free end of a deflectable plunger. The notches are located on opposite sides of a line joining the constrained end of the plunger and the pivot axis, and a ridge between the notches causes the free end of the plunger to slide into one or the other of the notches depending on the position of the carrier so that each depression of the plunger causes the carrier to change position.

The switch of U.S. Pat. No. 2,469,337 employs a movable contact or bridging element in the shape of a shallow V, the exterior of whose apex is configured and positioned to roll on a fixed center contact surface. A carriage assembly comprising a compression spring with a roller at one end and a notched abutment or block at the other is located between the bridging element and a transverse stationary rod. The roller is adapted to roll across the interior apex of the bridging element from one leg thereof to the other depending on the angular orientation of the center line of the spring relative to a line joining the center contact and the stationary rod.

The limiting positions of contact between the roller and the bridging element, and, therefore, the location and direction of force applied to the bridging element at the initiation of any switching action, are established by flanges on the bridging element which engage the roller. The location at which force is applied to the bridging element at the initiation of any switching action is substantially outside the limiting positions of the line of rolling contact between the bridging element and the fixed center contact surface.

Two of the notches on the block cooperate with the transverse rod to produce two normally stable positions for the carriage assembly in which the center line of the spring is in opposite angular orientations relative to the line joining the center contact and the rod. Two additional notches on the block cooperate with a pair of depending prongs on the bottom of a push button actuator to cause the carriage assembly to shift between stable positions upon successive depressions of the actuator.

In the switch of U.S. Pat. No. 3,586,806, an actuator assembly is coupled by means of a stud and yoke arrangement to a contact carrier which moves transversely to the direction of travel of a push button. An indexing slide, which forms part of the actuator assembly, is configured with a pair of tongues which alternately engage barbs on the push button so as to cause the assembly and slide therein to change position upon release of the push button.

All of these actuator designs require relatively large travel of the plunger or push button to achieve switching. In the implementations of U.S. Pat. Nos. 436,412, 3,277,264 and, 4,095,070 and British patent 1,233,571, large travel is dictated by the fixed relationship between the pivot axis and the line of action of the constrained end of the plunger. Because of this relationship, upon depression of the plunger, its free end must first slide along an incline into the valley of a notch before it can move the carrier. Lateral movement of the free end of the plunger is required to provide a moment arm through which force on the pivoting carrier can be transformed into a torque. The initial movement of the plunger has no effect on the position of the carrier. In addition, the effective length of the moment arm increases substantially as the pivoting carrier is rotated, thus requiring increased movement of the plunger during the actuation process.

In the switch apparatus of U.S. Pat. No. 2,469,337, one extreme position of the push button actuator is dictated by the requirement that the prongs thereon clear the ridges bounding notches on the notched block when the carrier assembly is oriented so that the ridges are in their highest positions. During actuation, the push button must first be depressed sufficiently to bring one prong into contact with the bottom of its associated notch, and further depressed sufficiently to cause the ridge between the notches which cooperate with the transverse rod to slip under the rod so that angular orientation of the carriage assembly may be changed. Such operation involves significant lost motion between the push button and the bridging element, and hence, relatively large push button travel.

In the case of U.S. Pat. No. 3,586,806, the requirement for relatively large push button travel is dictated by the fact that the push button must first be depressed sufficiently so that a barb thereon engages a tongue on a slide in the actuator assembly when the actuator assembly is in the position that the tongue is at its greatest distance from the rest position of the push button. The actuator assembly is then pulled by the push button to an overcenter position from which it snaps to an alternate stable position.

The applicant has devised a unique mechanism in which alternate action is achieved upon depression of a plunger with very small plunger travel. A moment arm is provided without requiring initial movement of the plunger and a minimum length lever arm is maintained throughout the actuation process. The mechanism design also provides for exceptionally high tactile feedback.

SUMMARY OF THE INVENTION

The alternate action mechanism of the present invention basically comprises a frame having a surface thereon and a rocker in rolling contact with the surface, the rolling contact occurring between first and second positions associated with limiting positions of the rocker. Force means is provided for applying a force to the rocker toward the surface and at least initially directed along an axis which intersects the surface between the first and second positions of the rolling contact. The force means may be an articulated plunger having a first portion slidably carried in the frame, and a second portion hingedly connected to the first portion and positioned to engage the rocker on a surface separated from the rolling contact. The surface on the rocker may be configured with a pair of depressions for receiving an end of the plunger and maintaining the end thereof at a substantially fixed location on the rocker as long as at least a predetermined force is being applied by the plunger. The depressions are located such that a separate depression is aligned with the plunger for each limiting position of the rocker.

DESCRIPTION OF THE PREFERRED EMBODIMENT

Figure 1:
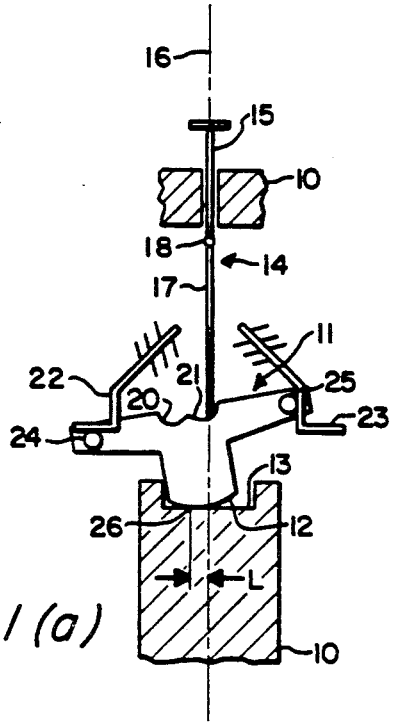
FIGS. 1(*a*)–1(*d*) are schematic illustrations showing the principles of operation of the applicant's invention and the interrelationship of the essential elements in sequence during operation.
Figure 1:
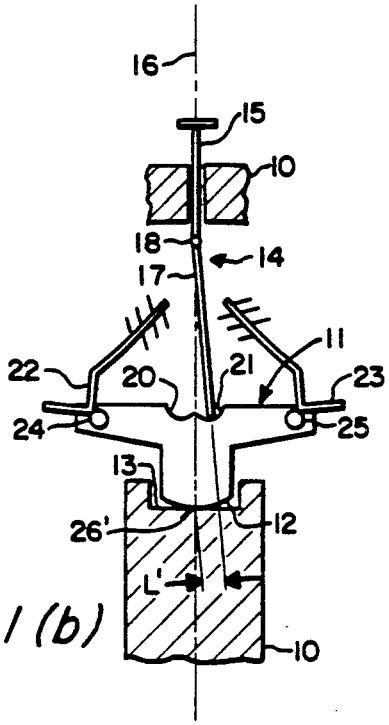
Figure 1:
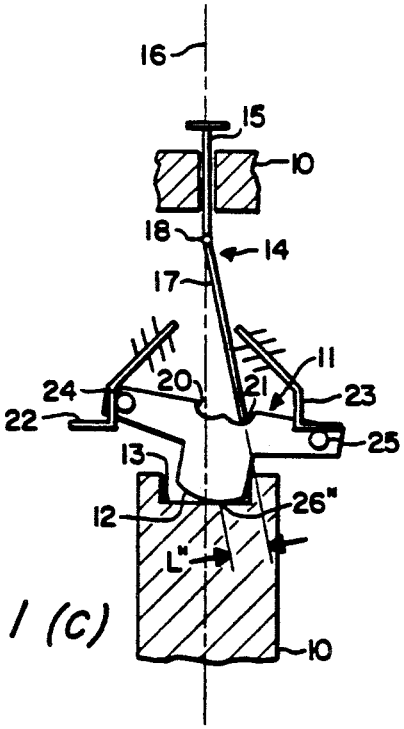
Figure 1:
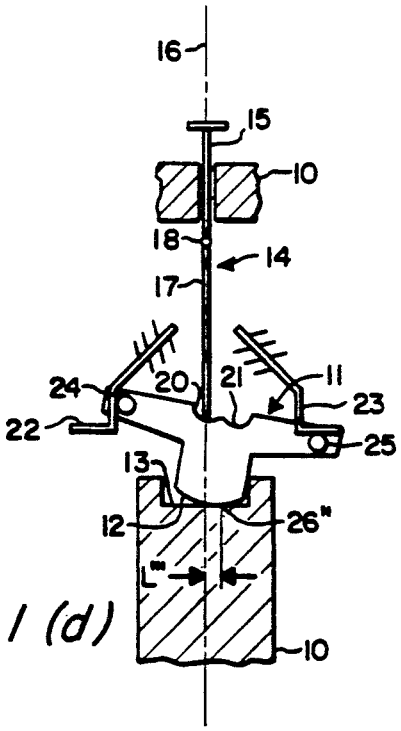

In the schematic illustrations of FIGS. 1(*a*) through 1(*d*), reference numeral 10 generally identifies portions of a frame or housing on which various components are mounted. Reference numeral 11 generally identifies a rocker having an arcuate surface 12 thereon positioned for rolling contact with a surface 13 on frame 10.

Reference numeral 14 generally identifies means for applying a force to rocker 11, shown as an articulated plunger having a first segment 15 slideably carried in frame 10 for movement along an axis 16, and a second segment 17 connected to segment 15 through a hinge joint 18 and extending substantially to rocker 11. Segment 17 is biased by hinge joint 18 and/or otherwise to normally extend along axis 16.

Rocker 11 is shown as symmetrical and generally T-shaped with arcuate surface 12 on the end of the center leg. Centered on the upper surface of the arms of the T are a pair of depressions 20 and 21 configured to receive the free end of plunger segment 17. Rocker 11 has two stable limiting positions of which one is shown in FIG. 1(*a*) and the other is shown in FIGS. 1(*c*) and 1(*d*). Rocker 11 is releasably maintained at one or the other of its limiting positions by means of leaf springs 22 and 23 which cooperate with projections 24 and 25 near the ends of the arms of the rocker.

FIG. 1(*a*) shows the various elements in one stable state, with no force being applied to plunger 14, and rocker 11 in its first limiting position. In that state, plunger segment 17 extends along axis 16 and depression 21 in rocker 11 is positioned on the axis. The axis of rotation of rocker 11 is effectively formed by the contact at 26 between arcuate surface 12 on the rocker and surface 13 on frame 10. This creates a moment arm of length L for any force applied to rocker 11 by plunger 14.

In FIG. 1(*b*), sufficient force has been applied to rocker 11 by plunger segment 17 to overcome the bias provided by leaf springs 22 and 23, and to start to pivot the rocker in a clockwise direction. In the position shown in FIG. 1(*b*), contact 26' between arcuate surface 12 and surface 13 has moved to axis 16. However, a moment arm is maintained because plunger segment 17 has pivoted to provide a force at an angle from axis 16. The length of the moment arm is shown as L', and is approximately equal to the length L. This substantially constant moment arm results in a minimum displacement required of plunger 14 to achieve repositioning of the rocker.

FIG. 1(*c*) illustrates the relative positions of the various elements as plunger 14 continues to displace rocker 11 to its second limiting position. Contact 26" between arcuate surface 12 and surface 13 has moved further to the right as the line along which force from plunger segment 17 moved to the right, thus maintaining a minimum moment arm length L" and minimizing plunger travel required to reposition rocker 11.

FIG. 1(*d*) illustrates the relative positions of the various elements after plunger 14 has been released. Due to the bias provided for plunger segment 17, it returns to alignment with axis 16 on which depression 20 is now centered. The contact between arcuate surface 12 and surface 13 remains at 26". However the line along which plunger segment 17 is directed has shifted to the opposite side of contact 26". The system now has a moment arm L'" equal to moment arm L in FIG. 1(*a*), but on the opposite side of contact 26" which forms the axis of rotation. Thus, the next depression of plunger 14 will rotate rocker 11 in a counterclockwise direction.

Figure 2:
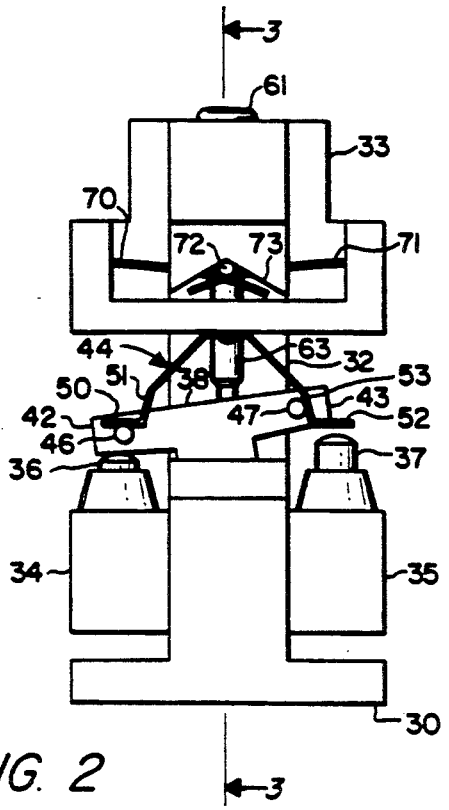
FIG. 2 is a front view of electrical switch device employing an alternate action actuator in accordance with applicant's invention.
Figure 4:
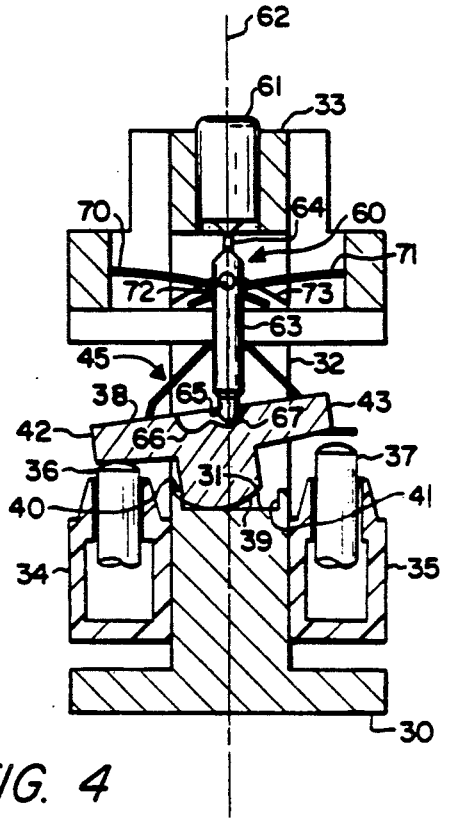
FIG. 4 is a sectional view of the electrical switch device of FIGS. 2 and 3 taken along lines 4—4 in FIG. 3.
Figure 3:
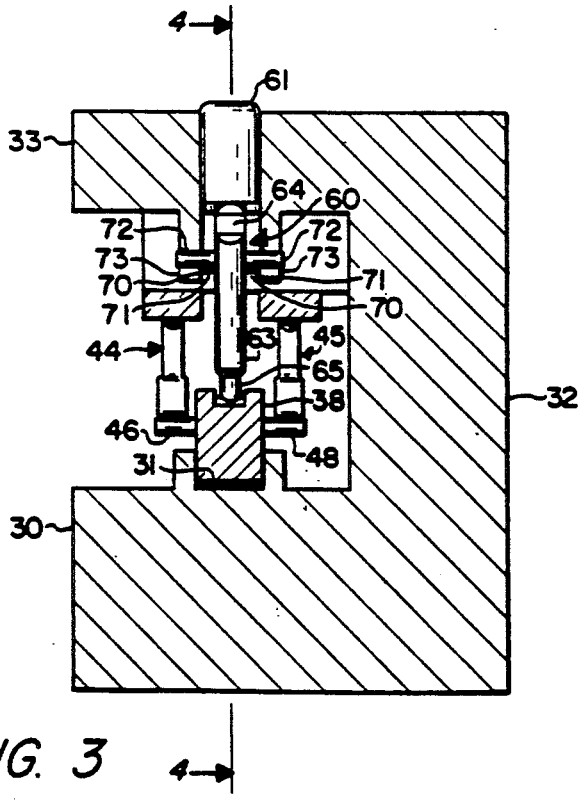
FIG. 3 is a sectional view of the electrical switch device of FIG. 2 taken along lines 3—3 in FIG. 2.

FIGS. 2–4 depict an electrical switch device with an alternate action actuator mechanism embodying the various elements and operational features illustrated in FIGS. 1(*a*) through 1(*d*). The various components of the switch device are mounted on a frame shown as having a base 30 with a surface 31 thereon, an attached support column 32, and a top member 33. A pair of snap acting switches 34 and 35, of which internal details are omitted in the sectional view of FIG. 4, are mounted on opposite sides of base 30. Switches 34 and 35 are equipped with actuator buttons 36 and 37 respectively. A T-shaped rocker 38 having an arcuate surface 39 on its center leg rests on base 30 with its arcuate surface in contact with surface 31. Rocker 38 is adapted for rolling contact with surface 31 which is provided with stops 40 and 41 at the edges of the surface.

Rocker 38 is configured with a pair of laterally extending arms 42 and 43. Switches 34 and 35 and rocker 38 are positioned so that arms 42 and 43 depress actuator buttons 36 and 37 respectively when the rocker is at one or the other of its limiting positions.

Rocker 38 is releasably maintained at one or the other of its limiting position by means of leaf springs generally identified by reference numerals 44 and 45. The leaf springs are identical, and each is attached at its midsection to top member 33. Leaf spring 44 has first and second extremities which cooperate with transverse projections 46 and 47 respectively on arms 42 and 43. Similarly, leaf spring 45 has first and second extremities which cooperate with transverse projections on arms 42 and 43. In FIG. 3, one of these projections is identified by reference numeral 48.

Each extremity of the leaf springs is configured with an end section which extends substantially parallel with surface 31 and an intermediate section which extends transverse thereto. In FIG. 2, the end and intermediate sections of one extremity of leaf spring 44 are identified by reference numerals 50 and 51 respectively. The end and intermediate sections of the other extremity of leaf spring 44 are identified by reference numerals 52 and 53 respectively.

For the position of rocker 38 shown in FIG. 2, leaf spring section 50 and a corresponding section of leaf spring 45 serve to maintain the rocker at a first limiting position in which actuator button 36 of switch 34 is depressed. Leaf spring section 53 and a corresponding section of leaf spring 45 also serve to maintain rocker 38 pivoted to its first limiting position. Leaf spring section 53 and the corresponding section of leaf spring 45 serve the further function of sliding rocker 38 against stop 40 to assure repeatable positioning of the rocker at its first limiting position. Similarly, when rocker 38 is in its second limiting position, the corresponding portions of the other extremities of the leaf springs serve to slide the rocker against stop 41.

An articulated plunger generally identified by reference numeral 60 in FIGS. 3 and 4 is slidably carried in top member 33. Plunger 60 includes a first segment 61 which is slideable in top member 33 along an axis 62, and a second segment 63 connected to the first segment through a section of reduced thickness 64 which serves a hinge between the segments. Because of the resilience of the material from which plunger 60 is formed, section 64 serves to bias segment 63 to normally extend along axis 62. Thus, segment 63 is adapted to pivot so as to follow rocker 38 as plunger 60 is depressed, and to return to alignment with axis 62 when plunger 60 is released.

Segment 63 of plunger 60 is configured with a rounded end 65 for engaging either of a pair of depressions 66 and 67 in the upper surface of rocker 38. The depressions serve to ensure that the force applied to rocker 38 by plunger 60 is applied at a substantially fixed location on the rocker throughout displacement of the plunger.

Plunger 60 is biased to its undepressed position by means of a pair of V-shaped cantilever springs 70 and 71 which cooperate with a pin or projections 72 extending transversely from plunger segment 63. Cantilever springs 70 and 71 are connected at their bights to top member 33, and serve to urge plunger 60 away from rocker 38. As shown, springs 70 and 71 intersect at projections 72 and are slightly deflected to form a V configuration which also biases plunger segment 63 to extend along axis 62. Plunger segment 63 is biased in a third way to extend along axis 62. This bias is provided by an inverted V configuration 73 formed in top member 33 which is arranged to cooperate with projections 72. Thus, as projections 72 are urged upwardly by springs 70 and 71, they are urged into the inverted V configuration which is aligned with axis 62, which further serves to align plunger segment 63 with axis 62.

In actual practice, the illustrated switch mechanism would be contained in an additional housing including a face plate embodying such functions as legends and lighting. These features have been omitted in the present description to avoid confusing the disclosure of essential structure and features of the applicant's invention. It is, however, apparent from the foregoing description that the applicant has provided an alternate action mechanism and electrical switch device utilizing such mechanism in which alternate action is accomplished with very small plunger displacement while providing exceptional tactile feedback.

Although a single embodiment of the applicant's invention has been shown and described in detail, other variations and embodiments which do not depart from the applicant's teachings will be apparent to those skilled in the relevant arts. It is not intended that coverage of the invention be limited to the disclosed embodiments, but only by the terms of the following claims.

The embodiments of the invention in which an exclusive property or right is claimed are defined as follows:

1. An alternate action mechanism comprising:

a frame having a first surface thereon;

a rocker positioned to rock on the first surface and configured for rolling contact with the first surface at a line of contact which moves transverse to itself between first and second positions corresponding to first and second limiting positions of said rocker; and a plunger operable to exert a force on said rocker toward the first surface, the initial force during a plunger actuation being directed along an axis which intersects the first surface between the first and second positions of the line of contact, whereby successive repetitions of said plunger actuation cause said rocker to move alternately to its first and second limiting positions; said plunger having a first segment mounted to move in a linear motion and a second segment mounted between said first segment and said rocker to translate therebetween, whereby said rocker rocks between said first and second positions in response to translational movement of said second segment caused by linear movement of said first segment.

2. The alternate action mechanism of claim 1 including retaining means releasably retaining said rocker at its first or second limiting position.

3. The alternate action mechanism of claim 2 wherein said retaining means comprises first biasing means biasing said rocker toward its first or second limiting position if said rocker is moved to within a predetermined range of the first or second limiting position respectively.

4. The alternate action mechanism of claim 3 wherein:

said rocker is T-shaped with first and second arms extending in the directions of movement of the line of contact and a center leg with a remote end having an arcuate surface formed thereon; and said first biasing means comprises a leaf spring having first and second extremities which engage the first and second arms of said rocker, said leaf spring being fixed to said frame at a location between the first and second extremities.

5. The alternate action mechanism of claim 4 wherein the surface of the first and second arms of said rocker remote from the arcuate surface is configured with first and second depressions adapted to receive an end of the second segment of said plunger, the first and second depressions being substantially aligned with said axis when said rocker is positioned so that the lien of contact is at its first and second positions respectively.

6. The alternate action mechanism of claim 4 including a first electrical switch adapted and positioned to be actuated by the first arm of said rocker when said rocker is in its first limiting position.

7. The alternate action mechanism of claim 6 including a second electrical switch adapted and positioned to be actuated by the second arm of said rocker when said rocker is in its second limiting position.

8. The alternate action mechanism of claim 4 wherein each extremity of said leaf spring includes an end section which extends substantially parallel with the direction of movement of the line of contact and an intermediate section which extends transverse thereto, said leaf spring being configured so that the rocker engages the end section of said leaf spring nearest the lien of contact and the intermediate section of said leaf spring on the other extremity thereof.

9. The alternate action mechanism of claim 3 wherein said plunger includes a first segment carried in said frame for movement along said axis and a second segment hingedly connected to the first segment and extending therefrom toward the first surface.

10. The alternate action mechanism of claim 9 including second biasing means biasing the second segment of said plunger to extend along said axis.

11. The alternate action mechanism of claim 10 wherein said second biasing means includes follower projections on the second segment of said plunger, the follower projections extending substantially parallel with the line of contact, and cantilever springs extending from said frame on opposite sides of said follower projections, said cantilever springs including spring segments with free ends crossed in a V configuration with the follower projections in the valley of the V configuration.

12. The alternate action mechanism of claim 11 wherein said second biasing means further includes an inverted V-shaped configuration on said frame positioned to receive the follower projections on the second segment of said plunger, the apex of the inverted V configuration being positioned to align the second section of said plunger with said axis.

13. The alternate action mechanism of claim 12 wherein the first and second segments of said plunger together are a unitary structure formed of a resilient material and the first and second segments are hingedly connected by means of a section of reduced thickness.

14. The alternate action mechanism of claim 2 including an electrical switch adapted and positioned to be actuated by said rocker at one of its first and second limiting positions.

15. An alternate action mechanism comprising:

a frame having a first surface thereon;

a rocker having an arcuate portion in rolling contact with the first surface, the rolling contact occurring between first and second positions associated with first and second limiting positions of said rocker; and force means for applying a force to said rocker at a location remote from the rolling contact, the force having a component toward the first surface and, at least initially during each application of force, directed along an axis which intersects the first surface between the first and second positions of the rolling contact; said force means having a first segment mounted to move in a linear motion and a second segment mounted between said first segment and said rocker to translate therebetween, whereby said rocker rocks between said first and second positions in response to translational movement of said second segment caused by linear movement of said first segment.

16. The alternate action mechanism of claim 15 wherein said force means and said rocker are adapted so that, during application, the force is exerted at a substantially fixed location on said rocker, whereby successive applications of the force cause said rocker to move alternately to its first and second limiting positions.

17. The alternate action mechanism of claim 16 wherein:

said rocker has a second surface separated from the rolling contact between the arcuate portion of said rocker and the first surface; and said force means includes a plunger movable toward the first surface and positioned to contact the second surface.

18. The alternate action mechanism of claim 17 including means for maintaining the contact between said plunger and the second surface at a substantially fixed location thereon as long as there is at least a predetermined contact force between said plunger and said rocker.

19. The alternate action mechanism of claim 18 including first biasing means biasing at least the portion of said plunger which contacts said rocker to extend along the axis.

20. The alternate action mechanism of claim 15 including retaining means for releasably retaining said rocker at either its first or second limiting position.

21. The alternate action mechanism of claim 20 wherein said retaining means comprises second biasing means biasing said rocker toward either its first or second limiting position if said rocker is moved to within a predetermined range of its first or second limiting position respectively.

22. The alternate action mechanism of claim 21 including a first electrical switch adapted and positioned to be actuated by said rocker in its first limiting position.

23. The alternate action mechanism of claim 22 including a second electrical switch adapted and positioned to be actuated by said rocker in its second limiting position.

24. The alternate action mechanism of claim 15 including an electrical switch adapted and positioned to be actuated by said rocker at one of its first and second limiting positions.

25. An alternate action mechanism comprising:

a frame having a fixed surface thereon;

a plunger having a first segment carried in said frame for movement along an axis intersecting and perpendicular to the fixed surface, said plunger having a second segment hingedly connected to the first segment and extending therefrom toward the fixed surface;

first biasing means biasing the second segment of said plunger to extend along the axis;

a rocker positioned between the fixed surface and the second segment of said plunger, said rocker being configured with an arcuate surface thereon making rolling contact with the fixed surface, contact occurring between first and second limiting positions on opposite sides of the intersection of the axis and the fixed surface, said rocker further being configured with first and second depressions therein separated from the arcuate surface and adapted to receive an end of the second segment of said plunger, the first and second depressions being substantially aligned with the axis when said rocker is positioned so that contact with the fixed surface occurs at the first and second limiting positions respectively; and second biasing means biasing said rocker toward first or second position when said rocker is moved so that contact occurs within a predetermined range of the first and second limiting positions; said plunger first segment mounted to move in a linear motion and said plunger second segment mounted between said first segment and said rocker to translate therebetween, whereby said rocker rocks between said first and second positions in response to translational movement of said second segment caused by linear movement of said first segment respectively.

* * * * *